US005133481A

United States Patent [19]

Mayfield

[11] Patent Number: 5,133,481

[45] Date of Patent: Jul. 28, 1992

[54] BOTTLE WITH COLLAPSIBLE SPOUT

[76] Inventor: Todd A. Mayfield, 405 Russell Ridge Dr., Lawrenceville, Ga. 30245

[21] Appl. No.: 645,744

[22] Filed: Jan. 25, 1991

[51] Int. Cl.[5] ..... A47G 19/00

[52] U.S. Cl. ..... 222/466; 222/479; 222/529; 222/530; 141/299

[58] Field of Search ..... 222/465.1, 479, 529, 222/530, 538, 568, 572, 466; 141/298-300, 290, 333, 382, 364, 346

[56] References Cited

U.S. PATENT DOCUMENTS

| | | | |
|---|---|---|---|
| 1,355,952 | 10/1920 | Even | 141/300 |
| 3,298,577 | 11/1967 | Chlystun . | |
| 4,073,413 | 2/1978 | Tabler et al. . | |
| 4,095,728 | 6/1978 | Chlystun . | |
| 4,236,655 | 12/1980 | Humphries | 222/465.1 |
| 4,267,945 | 5/1981 | Maynard, Jr. | 222/479 X |
| 4,351,454 | 9/1982 | Maynard . | |
| 4,492,313 | 1/1985 | Touzari . | |
| 4,492,324 | 1/1985 | Weber . | |
| 4,804,119 | 2/1989 | Goodall | 222/465.1 X |
| 4,834,269 | 5/1989 | Cone | 222/465.1 |
| 4,856,664 | 8/1989 | Gillispie et al. . | |
| 4,976,297 | 12/1990 | Peckels | 141/300 X |

*Primary Examiner*—Gregory L. Huson
*Attorney, Agent, or Firm*—James A. Hinkle

[57] ABSTRACT

A disposable plastic bottle used to contain fluid substances having an integral, flexible funnel spout, with sealable opening, featuring an external air vent integrally formed into the mouth of the spout suitable for accurately transferring fluids through tight filler openings which would ordinarily require the use of a separate funnel or spout. When the mouth of the spout is snugly inserted into a receptacle, the external air vent will provide a direct air passage to the contents of the bottle allowing the liquid to flow smoothly without restriction. The spout is integrally formed atop the bottle and comprises a plurality of bellows like ribs. Such ribs have a thinner cross-sectional wall than the side walls of the container body. This permits the spout to be flexed, enabling the ribs to collapse over-center and fold, allowing the spout to retain the flexed condition without external assistance, thereby creating a self latching feature. The spout can be fully or partially extended and shaped to retain the configuration the user needs to reach inaccessible filler holes. Once the desired amount of fluid has been transferred, the spout may then be retracted back to its packaged state and sealed with a threaded closure cap for storage or disposal.

6 Claims, 3 Drawing Sheets

BOTTLE WITH COLLAPSIBLE SPOUT

BACKGROUND OF THE INVENTION

1. Field of the Invention

The present invention relates generally to the field of bottles and more particularly to a plastic bottle having an integral, flexible funnel spout, capable of being shaped and then retaining a given configuration, without external assistance, to facilitate accurate pouring. More specifically a bottle is disclosed with an integral funnel spout having an integrally formed external air vent at the mouth of the spout, enabling the contents of the bottle to be transferred through the filler hole of another receptacle, without flow restriction.

2. Description of the Prior Art

Fluid substances used in the automotive industry such as motor oil, transmission fluid, antifreeze and many other similar fluids are generally packaged in disposable plastic bottles. The receptacles into which these fluids are poured can often be difficult to reach with existing bottles, and generally require the use of a separate funnel or spout to prevent product spillage. Various attempts have been made to overcome the spillage problem. Separate funnels are frequently used and there are spouts that fasten to the mouths of bottles, but these devices are frequently misplaced and are not accessible when needed. Plastic bottle shapes, particularly motor oil and transmission fluid bottles, have been modified wherein the top surface of the bottle slopes away from the mouth, across the width of the bottle, to provide some relief from obstacles near the receptacle. However when used as intended and with the angular surface closest to the receptacle, the mouth of the bottle is then further away from the receptacle. When the prior art bottles are used in this way, the chance of spillage increases even more.

In other prior art bottles in which longer necks have been added to the center of containers, there is still a requirement for the use of a separate funnel or spout because the necks cannot flex sufficiently enough to reach inaccessible filler holes. An existing container, as depicted in U.S. Pat. No. 4,492,324, overcomes some of these problems, but still has problems of its own. When grasping the container of said Patent to extend or shape the integral, flexible neck, one must squeeze the side walls of the cylindrical container body to secure an adequate grip. In doing so and when using desired flexible plastics, the pressure induced from gripping the cylindrical side walls of the container will allow the contents to be prematurely released from the spout before the neck has been extended and flexed into position, thus creating a slippery mess. Additionally, the neck of this type of bottle does not offer an integral gripping feature for extending the flexible neck into a pouring position. Generally a gripping feature is desirable for this type of container to prevent slippage when extending the neck, particularly if the hands of the user are not dry.

The present invention eliminates the majority of problems encountered with existing related art by offering additional features.

The presence of an integral grip handle on the container body used in conjunction with the integral grip ring collar formed into the flexible funnel spout allows the spout to be extended, flexed and retracted easier than existing bottles. Additionally, gripping the handle when extending the spout relieves any side wall forces normally induced on existing bottles of the type, thereby preventing premature spillage. The grip handle also allows for transporting the bottles with greater ease. As previously mentioned, the mouth of the spout has an integrally formed external air vent. When the spout is snugly inserted into a filler hole or tube, the contents of the bottle will have a direct air passage permitting the liquid to flow smoothly and quickly, without restriction, for adding or topping various fluid levels.

Having the integral flexible funnel spout with the bottle allows the transferred liquid to be controllable by simply tilting the container towards the vertical position while the mouth is still engaged with the receptacle. The funnel spout will permit various spout angles to be shaped, and retain a given shape, without external assistance, up to and just beyond 90 degrees. This is particularly useful when trying to reach a filler hole located in an inaccessible area, such as under the hood of an automobile or the like. Since the flexible funnel spout is integral to the container, the use of a separate funnel or spout is not necessary. This prevents the chance of misplacement, and therefore is more convenient.

The funnel spout is tubular in design, comprising a plurality of bellow type ribs, extending the length of the spout between the grip ring collar and the top of the container body. The bellows ribs are generally circular in shape, and are designed with a tapering thinner cross-sectional wall thickness than the cross-sectional wall thickness of the lower containment portion of the bottle. Each rib is designed with angular side walls, wherein a downwardly and outwardly extending surface comprises a conical portion, and a downwardly and inwardly extending surface comprises the adjoining conical portion. At the extremity of each inwardly and outwardly extending angular wall, a small radius forms a flexible hinge, enabling the spout to perform versatile bends so the user can maneuver in and around obstacles near filling receptacles without spillage. The horizontal center line of each rib is preferably equally spaced and parallel with the next adjacent rib throughout the length of the spout.

In one embodiment the outermost and innermost diameter of each rib is the same dimension as each adjacent rib. In another embodiment the innermost and outermost diameter of each rib preferably decreases in size as the ribs progress upwardly towards the top of the spout, thus creating a tapering effect on the overall length. In each embodiment the external air vent is located at the mouth, integrally formed into the threads, slanting down the neck and out through the grip ring collar. The vent is preferably positioned on the mold line of the spout nearest the grip handle on each embodiment. The opening at the mouth of the spout can be small or large depending on the intended use of the bottle. The mouth is connected to a neck having either conical, straight or spherical side walls with a thicker cross-section than the funnel spout.

The bottle of the present invention can be produced from a variety of flexible thermoplastics, however when used to contain liquid substances such as motor oil, transmission fluid, antifreeze and/or similar chemical products, high density polyethylene is the preferred plastic to be used. The versatility of the invention permits usage in many other applications wherein harsh chemicals are not prevalent and plastics such as polypropylene, polycarbonates, low density polyethylene or any other suitable plastic resin mixtures, capable of being blow molded, may be used.

As mentioned, bottles of the disclosed type are manufactured by the blow molding process. Although it is possible to produce a bottle of this nature on conventional extrusion blow molding equipment, the preferred method is injection blow molding, wherein a two stage process is required. In the first stage, an injection molded parison is formed resembling the shape of a hollow test tube. The parison is then transferred into a blow mold where it is subjected to air pressure and stretched to the outer confines of the bottle mold, thus creating a completely finished product.

Other objects, advantages and capabilities of the invention will become apparent from the following description taken in conjunction with the accompanying drawings, showing several embodiments of the invention.

DESCRIPTION OF THE PREFERRED EMBODIMENTS

Figure 4:
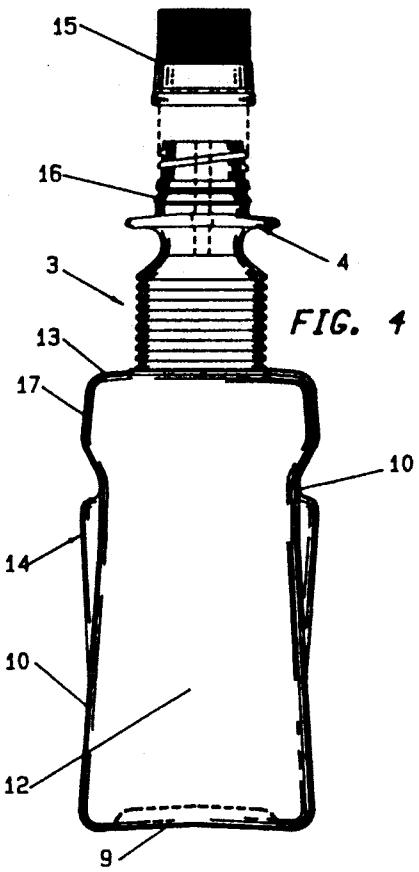
FIG. 4 is a right side elevational view wherein the integral spout is fully collapsed to a packaged state and showing a removable threaded closure cap.
Figure 3:
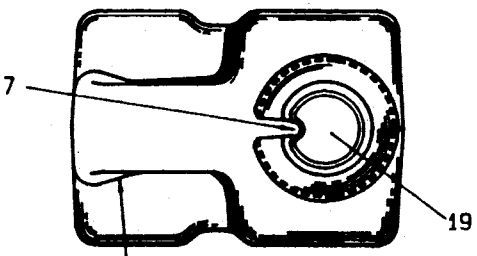
FIG. 3 is a top view of the bottle.

Referring to the drawings wherein like reference numerals designate corresponding parts throughout the several Figures, the bottle 1 includes a containment body 8, an integral flexible funnel spout 3, formed into top surface 13 of containment body 8, with an integrally formed external air vent 7, molded into mouth opening 19, extending down neck 6, through threads 5, and out through grip ring collar 4. The bottle is suitable for containing and accurately transferring liquids therefrom through a filler hole of another receptacle without flow restriction.

The container body 8 is generally rectangular in shape, having a bottom 9 with upstanding side walls 10, 11, 12 and 17 with a top surface 13. The vertical upstanding side walls of containment body 8 feature tapered surfaces wherein the outermost extremity of each tapered surface does not protrude beyond a symmetrical parallel dimension, which would prevent bottle 1 from being closely stacked side by side for effective packaging or efficient shelf space. The side walls 10 are substantially parallel to the mold line of container body 8 and feature integral gripping surfaces 14. Such gripping surfaces 14 prevent slippage when grasping bottle 1 and the surfaces are particularly useful when bottle 1 is tilted to the pouring position. FIG. 4 shows a right side elevational view of bottle 1, wherein sidewalls 10 of containment body 8 slope downwardly and outwardly from the base of side walls 17 blending with bottom surface 9. The wedge shaped configuration of side walls 10 also provide container body 8 with an additional non-slip gripping surface when bottle 1 is tilted to the pouring position.

The upper portion of side wall 11 preferably transforms into integral grip handle 2. The shape of grip handle 2 does not necessarily have to maintain the configuration shown as it can be distorted or elongated to coact with the size of container body 8, and can be larger or smaller depending upon the desired application. The grip handle 2 is also used for transporting bottle 1, although its primary function is to provide a means for securing an adequate grip on bottle 1. This will relieve any external side forces that would normally be induced on container body 8 by the user when removing threaded closure cap 15 from threads 5 on neck 6, or when pulling or pushing on grip ring collar 4 when extending and retracting integral flexible funnel spout 3 into a versatile pouring position and then back to a fully retracted position, thus preventing premature spillage.

Figure 1:
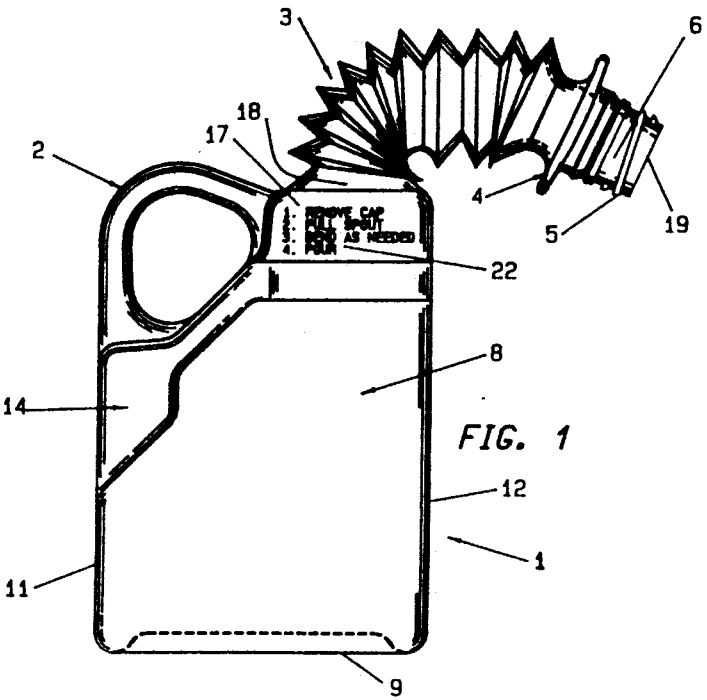
FIG. 1 is a side elevational view of one embodiment of a bottle wherein an integral flexible spout has been extended and flexed into a pouring position.

Upper side walls 17 of bottle 1 should preferably contain integral usage directions 22, as seen in FIG. 1, which would typically be molded into both side walls 17 to inform the user on how to use the bottle.

Figure 2:
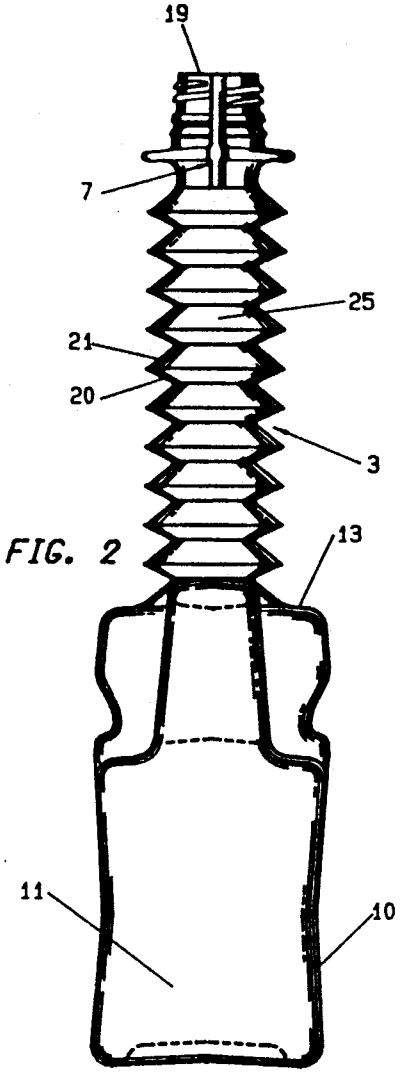
FIG. 2 is a left side elevational view of one embodiment wherein an integral funnel spout is fully extended in a straight position.
Figure 8:
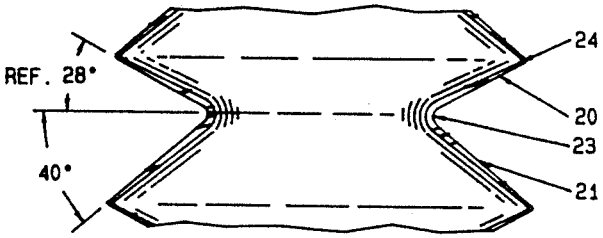
FIG. 8 is a partial sectional view of a portion of the rib configuration of the spout.
Figure 7:
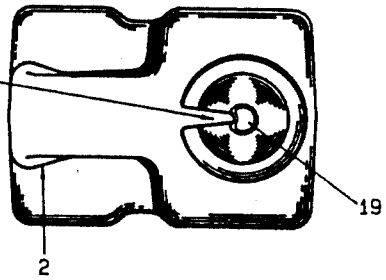
FIG. 7 is a top view of the bottle shown in FIG. 6.
Figure 11:
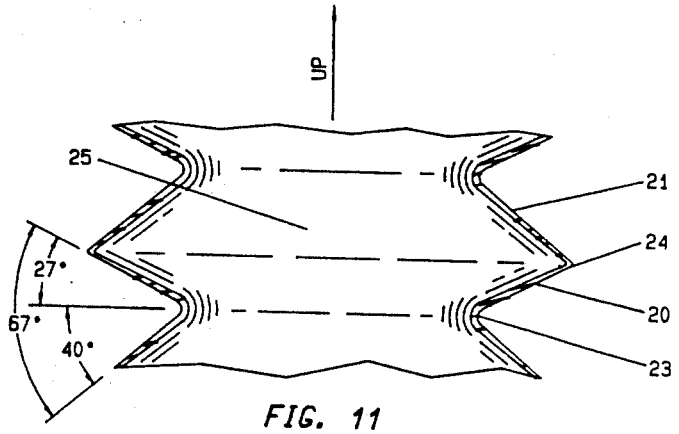
FIG. 11 is a partial sectional view of a portion of the spout rib configuration of the spout shown in FIG. 2.
Figure 12:
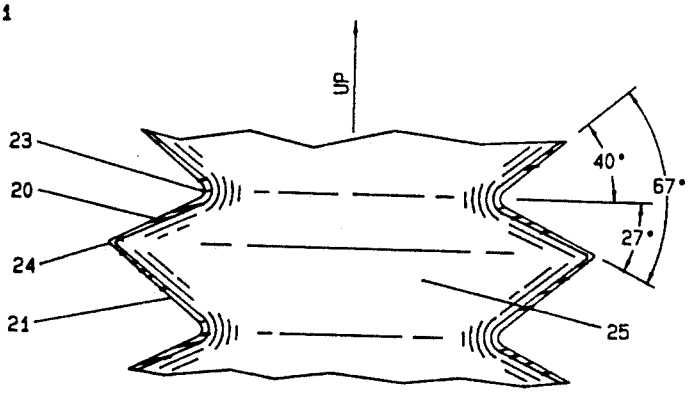
FIG. 12 is a partial sectional view of the rib configuration of the spout shown in FIG. 10.

Flexible funnel spout 3 is defined by a plurality of bellows ribs 25, shown in a fully extended position in FIG. 2. Each rib 25 is designed with tapering angular side walls 20 and 21, wherein a downwardly and outwardly extending surface 21 comprises a conical portion, and a downwardly and inwardly extending surface 20 comprises the adjoining conical portion. At the juncture of each inwardly and outwardly extending angular side wall 20 and 21, flexible hinges 23 and 24 are formed as shown in FIGS. 8, 11 and 12. In each bellows rib 25, the radius cross section of the hinge 23 is about 0.030 of an inch as it blends with angular walls 20 and 21. The angular walls 20 and 21 start at a thickness of about 0.024 of an inch at the radius of inner hinge 23, tapering outwardly towards outer hinge 24 and thinning to about 0.015 of an inch at the juncture of hinge 24 to a final radius cross section of hinge 24 of about 0.014 of an inch. In the embodiment of FIG. 1 the inwardly extending shorter wall 20 and outwardly extending longer wall 21 extend toward the centerline of the spout from hinge 23, wherein the preferable angle for wall 20, as seen in FIG. 11, is approximately 27 degrees, while the preferable angle for wall 21 is approximately 40 degrees.

Figure 5:
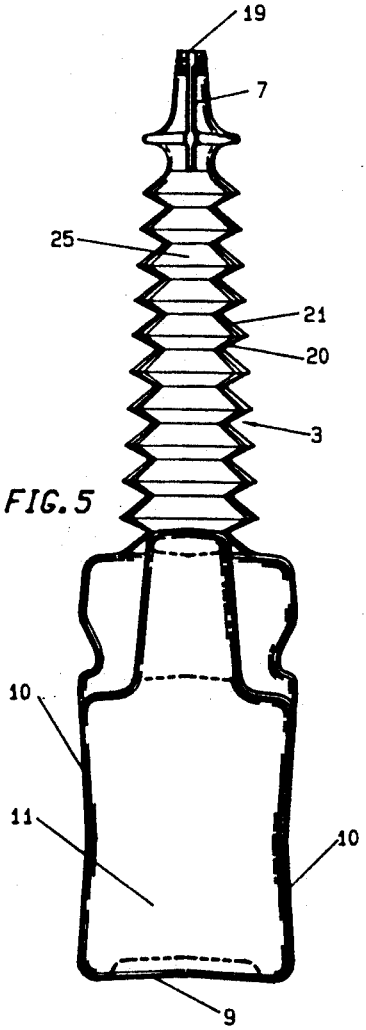
FIG. 5 is a left side elevational view of another embodiment wherein an integral tapered flexible spout is fully extended in a straight position.
Figure 6:
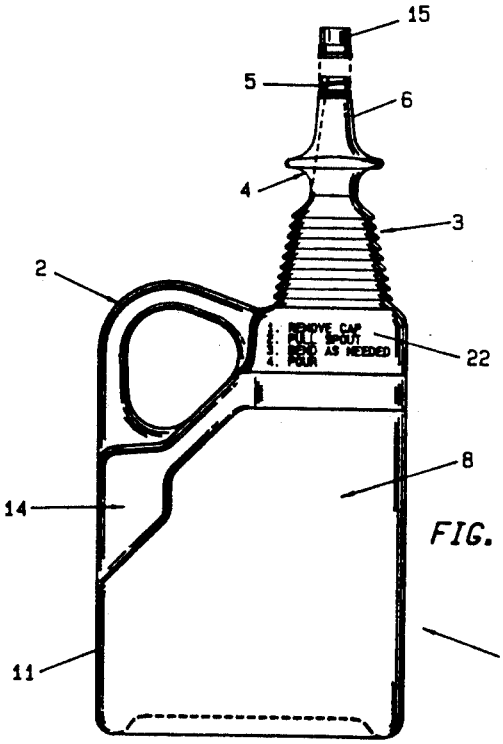
FIG. 6 is a side elevational view of the embodiment shown in FIG. 5, wherein the integral spout is fully retracted to a packaged state.

In the embodiment as the one shown in FIGS. 5 and 6, each consecutive rib 25 decreases in diameter as ribs 25 progress upwardly towards grip ring collar 4, of funnel spout 3. In this embodiment, as seen in FIG. 8, wall 20 changes angles slightly to about 28 degrees to accommodate the tapering effect, while the angle of outwardly extending wall 21 remains at 40 degrees. The tapering spout with thinner cross-sectional walls 20 and 21, permit the spout 3 to be flexed, enabling bellows ribs 25 to collapse one above the other and fold, allowing funnel spout 3 to retain the flexed condition without external assistance, thereby creating a self latching feature, for versatile manipulation.

The horizontal center line which separates each bellows half of each bellows rib 25 is preferably equally spaced and parallel with each adjoining rib 25 throughout the entirety of flexible funnel spout 3. As shown, flexible funnel spout 3 has 10 bellows ribs 25 in each embodiment, however the number and arrangement of ribs 25 may increase or decrease depending upon the desired application. In one embodiment the outermost and innermost diameter of each rib 25 is the same dimension as each progressive rib thereafter.

Figure 10:
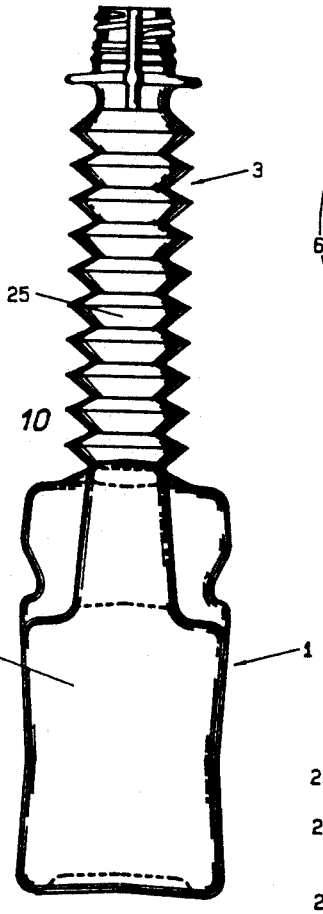
FIG. 10 is a left side elevation view of another embodiment wherein the angles of the rib configuration of the spout are reversed from that of the other embodiments.

In another embodiment the innermost and outermost diameter of each rib 25 preferably decreases in size as ribs 25 progress upwardly towards grip ring collar 4 of funnel spout 3, thus creating a tapering effect on the overall length of funnel spout 3. In yet a further embodiment as shown in FIGS. 10 and 12, the angles of walls 20 and 21 of funnel spout 3 are reversed wherein the outermost and innermost diameters of adjacent bellows are the same. However, the bellows can also maintain the reverse angle dimension in a tapering embodiment as shown in FIGS. 5 and 6.

Figure 9:
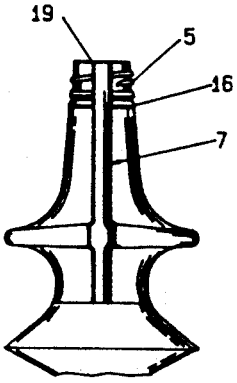
FIG. 9 is a partial elevation view of a portion of the neck of the tapered spout configuration.

As flexible funnel spout 3 may be produced in a variety of different shapes and sizes, so may be integral neck 6. Depending upon the application of bottle 1, neck 6 may have defined conical side walls as shown in FIGS. 5, 6 and 9, wherein neck 6 has a smaller mouth opening 19 than another embodiment as shown in FIGS. 1, 2, 3, 4 and 10. Regardless of the neck configuration, each embodiment of neck 6 features an integrally formed external air vent 7. The integral external air vent 7 is located on the mold line of neck 6 nearest grip handle 2 of container body 8, extending downwardly from mouth opening 19, running through threads 5, through the tapered gripping surface 16, and out through grip ring collar 4.

Various modifications may be made of the invention without departing from the scope thereof and it is desired, therefore, that only such limitations shall be placed thereon as are imposed by the prior art and which are set forth in the appended claims.

What is claimed is:

1. A plastic bottle having a base, a pair of side walls, a front wall and a rear wall all joined together to form a base and to form a top, an aperture located in the top and having an elongated flexible and collapsible spout mounted in conjunction with the aperture, the side walls and the rear wall molded together to form an integral loop handle, the spout having a proximal end terminating in the aperture at the top of the bottle and a distal end terminating in a threaded circular closure cap section, the closure cap section having an inwardly projecting wall portion defining an irregular air vent indentation parallel to the longitudinal access of the closure cap section and interrupting the exterior circular surface of the closure cap section permitting the free flow of ambient air to the distal end of the spout when the contents of the bottle are dispensed, an annular ring section being molded into a portion of the closure cap section thereby providing a gripping surface by which the collapsible spout may be readily extended, the annular ring section lying in a plane which is substantially perpendicular to the surface of the closure cap section, the annular ring section projecting outwardly from the surface of the closure cap section except at said inwardly projecting wall portion.

2. A plastic bottle as claimed in claim 1, wherein the side walls and the rear wall of the bottle are molded to form a vertically disposed cross-sectional area at the rear of the bottle, said area forming a gripping surface immediately under and adjacent to the loop handle.

3. A plastic bottle as claimed in claim 2, wherein the spout comprises a plurality of circular bellows formed by conical shaped sections having alternating short walls and long walls, the short walls projecting outwardly from the longitudinal axis of the spout at a lesser angle than the long walls, the juncture points of the short and long walls defining the fold rings for folding the bellows in an over-centering snap action to thereby lock the bellows in a closed position.

4. A plastic bottle as claimed in claim 3, wherein the bellows are formed by said conical shaped sections having successively decreasing diameters to form a spout of tapered shape.

5. A plastic bottle as claimed in claim 4, wherein the short legs project from the longitudinal axis of the bottle at an angle of at least 28 degrees.

6. A plastic bottle as claimed in claim 4, wherein the long legs project from the longitudinal axis of the bottle at an angle of at least 40 degrees.

* * * * *